United States Patent [19]

Brand

[11] 4,127,018

[45] Nov. 28, 1978

[54] VEHICLE DOOR OPENING APPARATUS

[76] Inventor: Wayne R. Brand, 21 Buena Vista, Corte Madera, Calif. 94925

[21] Appl. No.: 779,046

[22] Filed: Mar. 18, 1977

[51] Int. Cl.[2] ..... E05B 47/00

[52] U.S. Cl. ..... 70/282; 70/237; 70/277; 180/112

[58] Field of Search ..... 70/282, DIG. 46, 277, 70/283, 393, 255, 237, 453–455, 279; 200/42 R, 44; 361/171; 307/10 AT, 40; 180/114, 112

[56] References Cited

U.S. PATENT DOCUMENTS

| | | | |
|---|---|---|---|
| 2,028,852 | 1/1936 | Vincent | 70/283 X |
| 2,057,532 | 10/1936 | MacDonald | 70/277 X |
| 2,105,304 | 1/1938 | Wagner | 70/277 X |
| 2,155,298 | 4/1939 | Brill | 70/277 X |
| 2,376,846 | 5/1945 | Field et al. | 70/277 X |
| 2,431,381 | 11/1947 | Elliott | 200/42 R X |
| 2,473,664 | 6/1949 | Taylor | 70/282 |
| 2,967,916 | 1/1961 | Williams | 200/44 X |
| 3,182,144 | 5/1965 | Shoe | 70/277 X |
| 3,541,874 | 11/1970 | Du Rocher | 70/279 X |
| 3,644,745 | 2/1972 | Bell | 200/42 R X |
| 3,720,284 | 3/1973 | Myers | 307/10 AT X |
| 3,777,306 | 12/1973 | Speickhoff | 180/114 X |
| 3,846,640 | 11/1974 | Mihlhauser | 361/171 X |

FOREIGN PATENT DOCUMENTS

| | | | |
|---|---|---|---|
| 974,313 | 9/1975 | Canada | 180/114 |
| 14,113 of | 1907 | United Kingdom | 70/283 |
| 459,621 | 1/1937 | United Kingdom | 200/44 |
| 1,228,927 | 4/1971 | United Kingdom | 70/455 |

*Primary Examiner*—Rodney H. Bonck

*Attorney, Agent, or Firm*—Townsend and Townsend

[57] ABSTRACT

A cartridge mounted in a sleeve on the exterior of a motor vehicle door receives a planar card having raised, conductive indicia for completing an electric circuit on a plate forming a part of the cartridge. The circuit energizes a solenoid attached to an interior door handle of the vehicle for rotating the handle to unlock the door when the vehicle keys have been lost, misplaced or inadvertently left in the ignition, and the doors of the vehicle have been locked.

6 Claims, 4 Drawing Figures

VEHICLE DOOR OPENING APPARATUS

PRIOR ART

The following prior art is considered pertinent:
U.S. Pat. No. 3,344,629
U.S. Pat. No. 3,134,254
U.S. Pat. No. 3,392,558
U.S. Pat. No. 3,266,278
U.S. Pat. No. 3,347,072

BACKGROUND OF THE INVENTION

This invention relates to an apparatus for opening a vehicle door when the keys to the vehicle have been misplaced.

Often, motor vehicle operators leave the keys to the vehicle in the ignition switch and lock the vehicle doors, or lose their keys altogether. A spare key is usually not on the person of the operator and accordingly, the only alternative in such a situation is to break a window to gain access to the interior of the vehicle or to call a locksmith, neither of which is a pleasant or inexpensive solution.

This invention provides apparatus, part of which is carried on the person of the operator, for use with an auxiliary tamper-proof door operator installed on the vehicle in just such an emergency. Unlike an extra key, the apparatus on the person of the operator comprises a plastic card, similar to a credit card having letters and numbers embossed only slightly above its surface, which is convenient to carry in the wallet of the operator along with his or her credit cards, which is inserted into the auxiliary door operator on the vehicle to open the door so that keys left in the ignition or an extra key in the glove compartment may be retrieved.

SUMMARY OF THE INVENTION

In accordance with the invention, the door operator includes a cartridge having a lower base plate and an upper contact plate mounted in a housing in a vehicle door. The housing is inserted in a sleeve mounted on the outer surface of the vehicle door and provided with a weather proof seal forming an entrance opening for a plastic card having embossed raised indicia on an upper surface. The indicia on the card includes a letter and/or number code which fits exactly into depression in the contact plate to close an electric circuit to a solenoid mounted in the door and connected to the door handle for raising the handle to unlock the door when the card is inserted into the housing. In conventional vehicle doors, the interior and exterior door handles, the key locking device, and the latch button are all interconnected to the door lock by lever arms. Thus raising the latch button moves a lever arm which rotates the door handle and unlocks the door lock. Similarly, turning the key in the key locking device moves a lever arm which rotates the door handle, raises the latch button, and unlocks the door lock. Thus if a solenoid is connected to the shaft which extends from the latch button, activating the solenoid causes the latch button to move upward thereby moving a lever arm which rotates the door handle and unlocks the door lock. The contact plate and base plate are normally biased towards each other by three spring clips in the housing to keep the plates in proper position and to prevent tampering with the device. Because the force exerted by the spring clips is proportional to the amount the spring clips are compressed, only a slight force need be overcome to insert a relatively thin object, such as a plastic card similar to a credit card. Embossed arrow indicia on the front of the card will enter indentations on the front of the contact plate to separate the contact and base plates to permit entry of the card between the plates so that the circuit to the solenoid may be completed. The embossed arrow indicia, like the indicia appearing on a credit card, are raised only slightly in comparison to the thickness of the card so that when the user exerts a force to withdraw the card, the relatively weak force is overcome and the arrow indicia are unseated from the depressions in the contact plate.

BRIEF DESCRIPTION OF THE DRAWING

Further objects and advantages of the invention will become apparent from the following descriptions and claims, and from the accompanying drawing, wherein:

DETAILED DESCRIPTION OF THE PREFERRED EMBODIMENT

Figure 4:
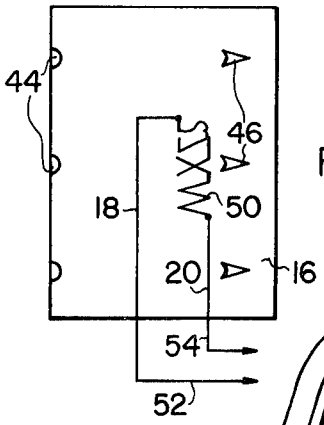
FIG. 4 is a cross-sectional view taken substantially along the plane indicated by line 4—4 of FIG. 2.
Figure 1:
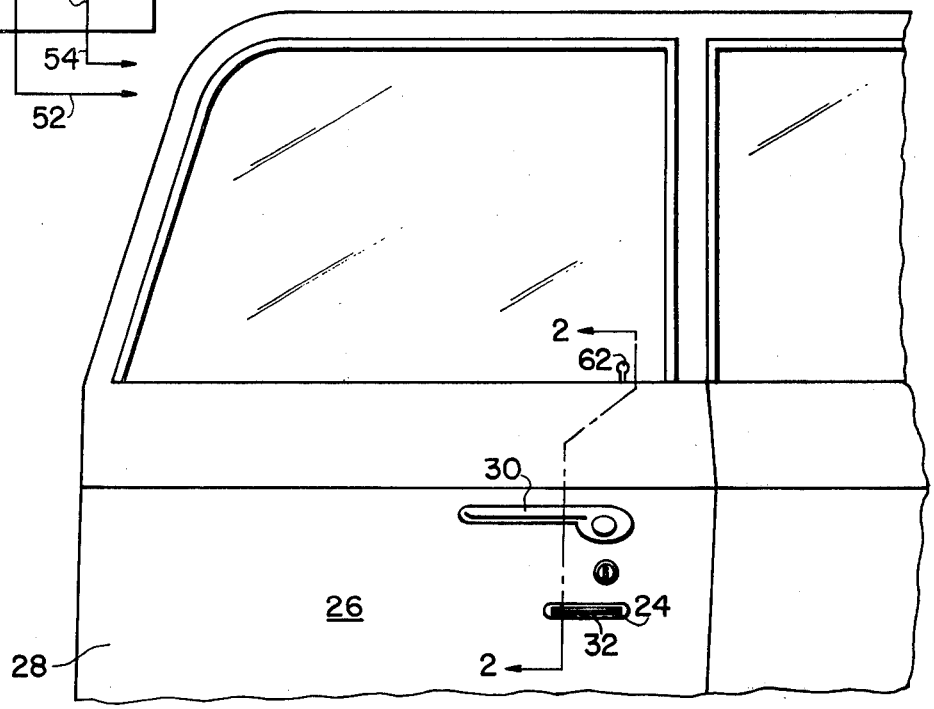
FIG. 1 is a side view in elevation of a motor vehicle equipped with a door operator of the present invention.
Figure 3:
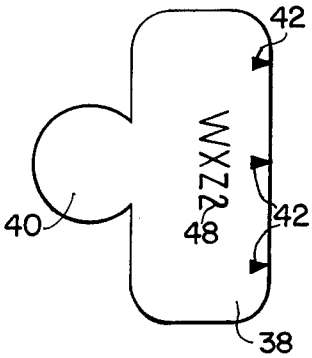
FIG. 3 is a top plan view of a coded card used to open the vehicle door of FIG. 1.

Referring now to the drawing in detail, wherein like numerals indicate like elements throughout the several views, the door operator 10 of the present invention includes a cartridge 12 housing a lower base plate 14 formed from insulative material and an upper contact plate 16 having conductive wires 18, 20 printed thereon in face-to-face relation with lower plate 14. Three spring clips 22, 22B, and 22C between cartridge 12 and the lower plate 14 and the upper plate 16 and between cartridge 12 and both plates at rear of cartridge keeps plates in proper position in the housing and prevents an unauthorized object from being indiscriminantly inserted therebetween.

Cartridge 12 is inserted in a sleeve 24 mounted to the interior of the outer surface 26 of a vehicle door 28 below handle 30. Sleeve 24 has an entrance passage 32 open at the exterior of door 28 sealed by deformable rubber lips 34, 36 in contact to form a weather-proof seal.

A substantially planar plastic card 38 provided with a circular tab 40 forming a handle is adapted to be inserted between deformable rubber lips 34, 36 in entrance passage 32. Card 38 includes embossed or raised arrow indicia 42 adjacent the front edge thereof which enter into registration with indentations 44 on the bottom surface of contact plate 16 to separate the plate 16 from base plate 14 enabling the card 38 to be inserted between the plates. Once inserted, arrow indicia 42 seats in similarly shaped depression 46 on the bottom surface of contact plate 16, which enables coded indicia 48, comprising a series of raised letters having metallic conducting paint on the surface thereof to be inserted in mating depression 50 on the bottom surface of contact plate 16 to electrically connect in series printed conductors 18 and 20 on contact plate 16.

Figure 2:
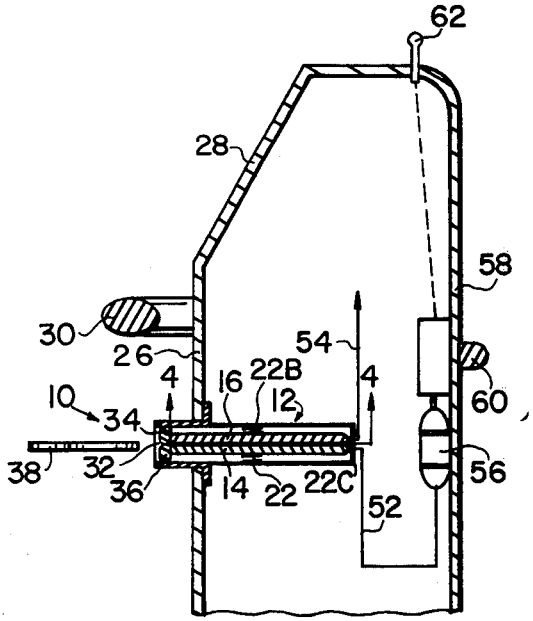
FIG. 2 is a cross-sectional view taken substantially along the plane indicated by line 2—2 of FIG. 1.

The ends of conductors 18 and 20 are attached by leads 52 and 54, respectively, to a solenoid 56 and a power source, such as the vehicle battery, respectively. Solenoid 56 is mounted on the interior surface 58 of door 26 and connected to the interior door handle 60 and latch button 62 to unlock door 26 when card 38 is inserted in cartridge 12 to complete the series circuit. The door handle 60 and the latch button 62 are connected to one another in conventional vehicle doors by a lever arm (not shown). Thus rotation of the key locking device (not shown) causes the lever arm to rotate thereby moving the latch button 62 either upward or downward, depending on whether the door is to be locked or unlocked. Similarly, movement of the latch button 62 causes the lever arm to rotate thereby locking or unlocking the door lock. The solenoid is preferably connected to the lever arm proximate the door handle 60, as shown in FIG. 2, or may be connected to the shaft (not shown) which extends from the latch button 62.

Without the proper letter combination 48 to match identically the depression 50 in contact plate 16, the door 26 cannot be opened. Further, spring clips 22, 22B, and 22C keep the plates properly housed and positioned and prevent the plates from being pried apart, except by a card containing arrow indicia 42. Card 38 can be conveniently carried in a wallet along with other credit cards so as to be readily available for use in an emergency.

While a specific embodiment of a vehicle door opening apparatus has been disclosed in the foregoing description it will be understood that various modifications within the spirit of the invention may occur to those skilled in the art. Therefore, it is intended that no limitations be placed on the invention except as defined by the scope of the appended claims.

I claim:

1. In combination with a hollow motor vehicle door having a pair of spaced walls and a door handle mounted on an exterior surface of one of said walls in the interior of said vehicle, apparatus for unlocking said door comprising:

a sleeve extending through the other of said walls and having an opening on the exterior surface of said other of said walls;

a cartridge mounted in said sleeve, including a contact plate having a conductive circuit mounted on a surface thereof, portions of said circuit being spaced by a series of depressions forming coded indicia, the front edge of said contact plate having a series of indentations;

a base plate having a surface in contact with the conductive surface of said contact plate; and means for urging said base plate surface and contact plate surface towards each other;

solenoid means mounted in said hollow vehicle door connected to said vehicle door handle within the interior of said vehicle;

conductor means for connecting the spaced portions of said circuit mounted on said contact plate in series with said solenoid means and a source of electrical power; and substantially planar card means insertable through said sleeve between said contact plate and base plate for completing said electrical circuit on said contact plate to energize said solenoid means to rotate said door handle to unlock said vehicle door, said card means including raised, coded indicia having metallic conductive coating on the surface thereof exactly fitting said depression in said contact plate to complete said electrical circuit mounted thereon, the front edge of said card means having arrow indicia raised to a height that is small relative to the thickness of said card for registering with said indentations on said contact plate to thereby raise and separate said contact plate relative to said base plate against the bias of said urging means.

2. The combination of claim 1, wherein said sleeve includes a pair of deformable lips in contact to form a seal to the entrance to said sleeve.

3. The combination of claim 2, wherein said deformable lips are rubber.

4. The combination of claim 1, wherein said contact plate includes a second series of depressions in the shape of said arrow indicia for receiving the arrow indicia on said card when inserted between said contact plate and base plate.

5. The combination of claim 1, wherein said card includes a tab forming a handle.

6. The combination of claim 1, wherein said urging means is a spring clip between the bottom of said cartridge and base plate.

* * * * *